US009585426B2

(12) United States Patent
Megat Abdul Aziz et al.

(10) Patent No.: US 9,585,426 B2
(45) Date of Patent: Mar. 7, 2017

(54) GLOVE HAVING FOAM LINING FOR SWEAT MANAGEMENT

(71) Applicant: Ansell Limited, Richmond, Victoria (AU)

(72) Inventors: Putri Faridatul Akmar Megat Abdul Aziz, Selangor (MY); Norazilayati Rastam, Selangor (MY); Ahmad Helmi Ujar, Selangor (MY); Zainorah Awang, Selangor (MY)

(73) Assignee: Ansell Limited, Victoria (AU)

( * ) Notice: Subject to any disclaimer, the term of this patent is extended or adjusted under 35 U.S.C. 154(b) by 198 days.

(21) Appl. No.: 14/552,968

(22) Filed: Nov. 25, 2014

(65) Prior Publication Data

US 2015/0157072 A1 Jun. 11, 2015

Related U.S. Application Data

(60) Provisional application No. 61/909,117, filed on Nov. 26, 2013.

(51) Int. Cl.
*A41D 19/00* (2006.01)
*A61D 19/02* (2006.01)

(52) U.S. Cl.
CPC ..... *A41D 19/0058* (2013.01); *A61D 19/02* (2013.01); *A41D 2400/62* (2013.01)

(58) Field of Classification Search
CPC ..... A41D 19/0006; A41D 19/02; A61B 19/04
USPC ..... 2/164, 161.7, 167, 168, 169
See application file for complete search history.

(56) References Cited

U.S. PATENT DOCUMENTS

| | | | | |
|---|---|---|---|---|
| 2,083,684 | A * | 6/1937 | Burke | A41D 19/0065 2/168 |
| 2,293,927 | A | 8/1942 | Beal | |
| 2,434,035 | A * | 1/1948 | De Laney | B29D 99/0067 2/168 |
| 2,867,849 | A * | 1/1959 | Drew | B29C 41/14 264/233 |
| 4,143,109 | A * | 3/1979 | Stockum | B29C 37/0067 264/112 |
| 4,439,473 | A | 3/1984 | Lippman | |
| 4,514,460 | A | 4/1985 | Johnson | |
| 4,555,813 | A | 12/1985 | Johnson | |
| 5,948,707 | A | 9/1999 | Crawley et al. | |
| 6,348,258 | B1 | 2/2002 | Topolkaraev et al. | |
| 7,771,644 | B2 * | 8/2010 | Flather | B29C 41/14 2/169 |
| 7,803,438 | B2 * | 9/2010 | Flather | A41D 19/0065 2/167 |

(Continued)

FOREIGN PATENT DOCUMENTS

| | | |
|---|---|---|
| EP | 1608808 A1 | 12/2005 |
| EP | 1608808 B1 | 1/2008 |
| WO | WO-0158656 A1 | 8/2001 |

OTHER PUBLICATIONS

European Standard EN 420: 2003(E) (p. 1,2 and 10-16).

(Continued)

*Primary Examiner* — Tejash Patel
(74) *Attorney, Agent, or Firm* — Moser Taboada

(57) ABSTRACT

Gloves having a foamed polymeric, elastomeric, or latex foam layer disposed on a non-foamed polymeric, elastomeric, or latex structural or liquid resistant layer are disclosed.

22 Claims, 6 Drawing Sheets

(56) References Cited

U.S. PATENT DOCUMENTS

| | | | | |
|---|---|---|---|---|
| 8,088,461 | B2 * | 1/2012 | Fujihana | A41D 19/01558 2/159 |
| 8,353,883 | B2 | 1/2013 | Johnson et al. | |
| 8,985,469 | B2 * | 3/2015 | Coombes | A41D 19/0062 235/375 |
| 2002/0076503 | A1 | 6/2002 | Borreani et al. | |
| 2003/0066120 | A1 | 4/2003 | Tremblay-Lutter | |

OTHER PUBLICATIONS

Brochure of Ansell Occupational Healthcare 2002.
Declaration of Mr. Paul McMorrow Dated Sep. 8, 2010.
Declaration of Mr. Robert Gaither Dated Sep. 11, 2010 Including Exhibits A-1, B-1, A-2, B-2.
Notice of Opposition to a European Patent, Patent No. 1852548, Application No. 07012481.3, 19 Pages, Dated Sep. 14, 2010.

* cited by examiner

GLOVE HAVING FOAM LINING FOR SWEAT MANAGEMENT

This application claims the priority of U.S. Prov. Appln. 61/909,117, filed 26 Nov. 2013, the contents of which are incorporated herein in their entirety.

Embodiments of the present invention generally relate to gloves and, more particularly, to double-layered elastomeric gloves having sweat management properties.

Gloves are used in many medical, industrial, and household settings to protect the hands of users from germs, viruses, bacteria, chemicals, dirt, and the like. Therefore, it is often important that users vigilantly wear gloves. However, many such gloves are made of elastomeric, polymeric, or latex materials, which trap perspiration, leading to a clammy, unhygienic condition as well as feeling of discomfort. Consequently, gloves are not always worn.

Past attempts to solve this problem have included supported gloves, which have a polymeric coating disposed on a fabric liner, including flocked fabrics. However, these gloves shed the flock, which is not acceptable in many environments. Moreover, these gloves tend to be very thick, leading to a loss in dexterity and discomfort. Unsupported, foamed latex gloves capable of providing good sweat management in the past have been relatively thick, also leading to a loss in comfort. Therefore, thin gloves that manage perspiration without using flock represent an advance in the art.

SUMMARY

Gloves having at least two elastomeric layers, a foamed foam layer and a non-foamed structural or liquid resistant layer, in accordance with embodiments of the present invention, substantially as shown in and/or described in connection with at least one of the figures, as set forth in the claims, are disclosed. Various advantages, aspects, and novel features of the present disclosure, including details of exemplary embodiments thereof, will be more fully understood from the following description and figures.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments. Furthermore, it is to be understood that elements and features of one embodiment may be in other embodiments without further recitation and that, where possible, identical reference numerals have been used to indicate comparable elements that are common to the figures.

DETAILED DESCRIPTION

Figure 1:
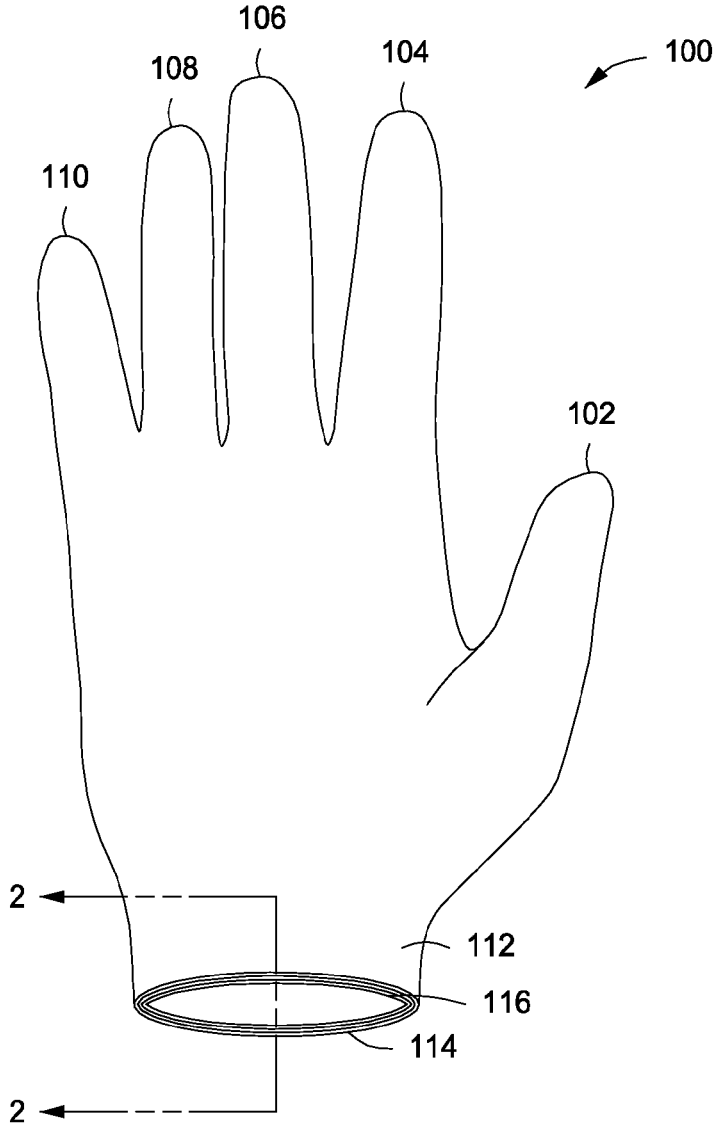
FIG. 1 depicts a perspective view of a glove according to embodiments of the invention.

Embodiments of the present invention comprise an elastomeric, polymeric, or latex article such as a glove having at least two layers. FIG. 1 depicts a perspective view of a glove according to embodiments of the invention. Glove 100 comprises thumb 102, fingers 104, 106, 108, 110, and cuff 112. Glove 100 further comprises foam layer 116 and structural or liquid resistant layer 114. In some embodiments of the invention, foam layer 116 and structural or liquid resistant layer 114 comprise the same elastomeric, polymeric, or latex material. In some embodiments of the invention, foam layer 116 and structural or liquid resistant layer 114 comprise different elastomeric, polymeric, or latex materials. In at least one exemplary embodiment of the present invention, foam layer 116 and/or structural or liquid resistant layer 114 comprises natural rubber latex. Alternatively, in at least one exemplary embodiment of the present invention, foam layer 116 and/or structural or liquid resistant layer 114 comprises a nitrile butadiene rubber material (i.e., termed nitrile or NBR). In embodiments, both layers comprise more than 50% of a shared elastomer. In embodiments, both layers comprise more than 90% of a shared elastomer.

Figure 2:
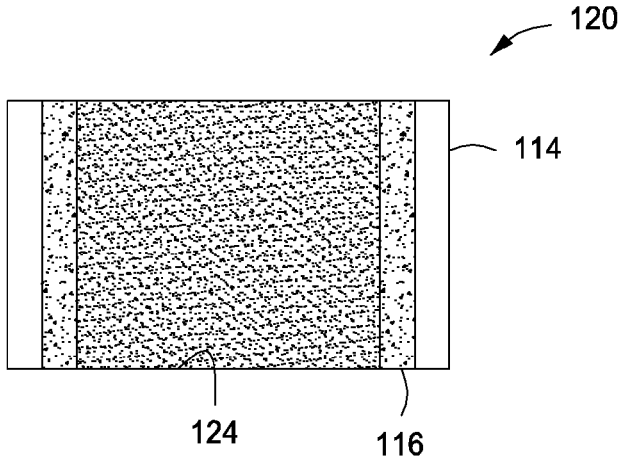
FIG. 2 depicts a cross section of the glove of FIG. 1, in accordance with embodiments of the invention.
Figure 3:
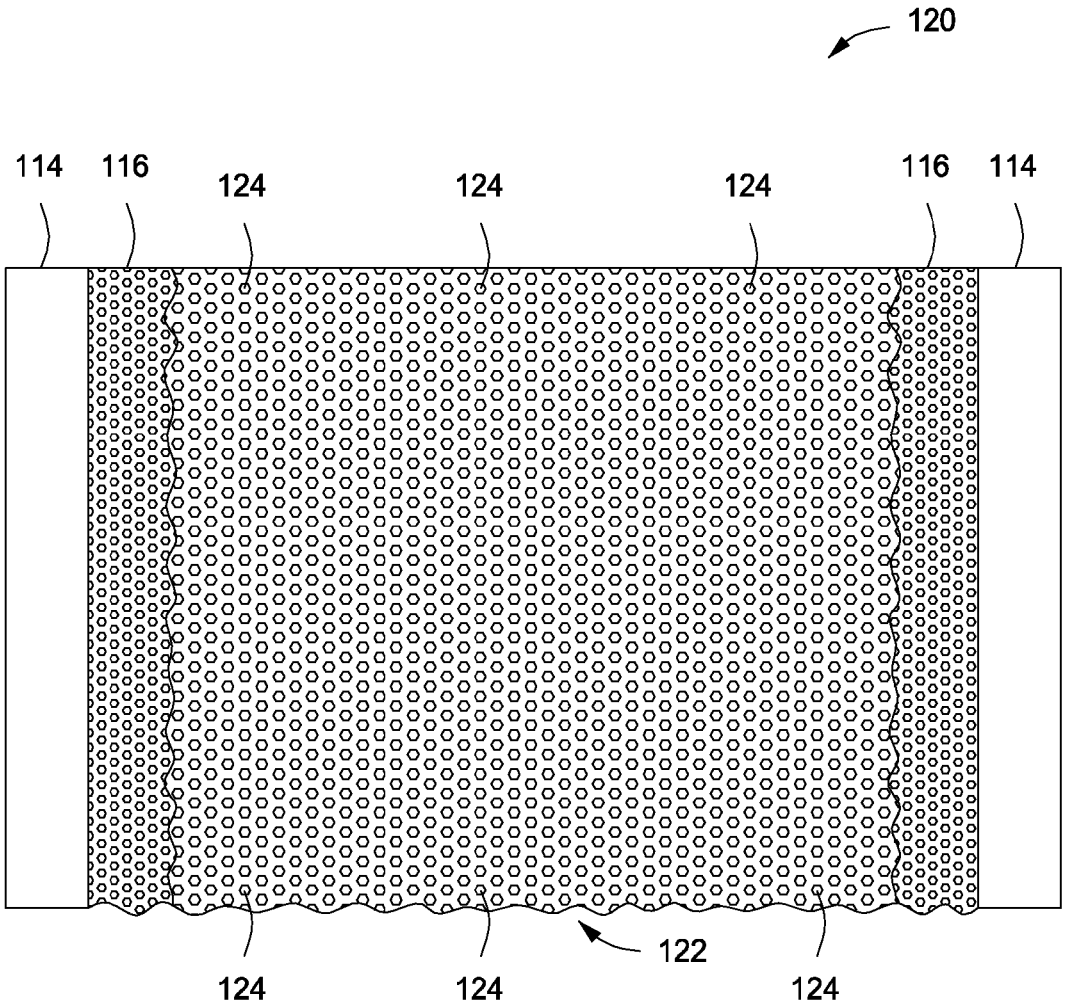
FIG. 3 depicts a close up view of the cross section of FIG. 2, according to embodiments of the invention.

FIG. 2 depicts a cross section of the glove of FIG. 1, in accordance with embodiments of the invention. Cross section 120 shows structural layer 114 with foam layer 116 disposed thereon. Cross section 120 further shows that foam layer 116 is foamed and comprises foam cells 124. The cross-section includes two cross-sections across the layers of the glove, and a face-on view of the foam surface of the glove. As illustrated, the article has the foam layer on the interior. Other embodiments utilize the foam layer on the exterior FIG. 3 depicts a close up view of the cross section of FIG. 2, according to embodiments of the invention. Foam layer 116 comprises a plurality of foam cells 124. In some embodiments of the invention, foam cells 124 are substantially open cells (such that those of skill in the art of dipped foam layers would deem the layer an open cell layer). The scalloped edge 122 of foam layer 116 further demonstrates that foam cells 124 are open cells. It can be seen that open cells appear as voids in foam layer 116, particularly on the surface of foam layer 116. The open celled feature of foam cells 124 allows the cells to adsorb and absorb perspiration, drawing moisture and perspiration away from the skin of the wearer of glove 100. Moreover, the open celled nature imparts a "spongy" feel to the wearer, promoting comfort. In some embodiments, the polymeric, elastomeric, or latex comprises a hydrophilic polymer, such as formed from one or more of aqueous- or non-aqueous polyurethanes. In some embodiments, article 100 comprises a third polymeric layer, disposed either between foam layer 116 and structural layer 114 or on top of structural layer 114.

Structural or liquid resistant layer 114 may be of any practical thickness for a glove. In embodiments of the invention, structural or liquid resistant layer 114 ranges in thickness from about 0.002 inch to about 0.010 inch (about 2 to about 10 mils, or about 50 to about 205 micrometer (mcm)). Foam layer 116 also comprises any practical thickness and ranges from, in some embodiments, for example, about 0.001 inch to about 0.004 or 0.005 or 0.010 inch (about 1 to 5 or 10 mil, or about 25 to about 125 or 250 mcm). Embodiments of the invention comprise a glove, for example, in which structural or liquid resistant layer is for example about 0.005 inch (or from about 2 to about 10 mil), and foam layer 116 ranges from about 0.001 inch to 0.002 about inch. Such a glove has surprising been discovered to provide five times the water absorption capability of a standard latex glove (4-5 mils thickness) lacking a foam layer. Additionally, embodiments of the invention comprise a glove, for example, in which structural or liquid resistant layer is for example about 0.0048 inch (or from about 2 to about 10 mil), and foam layer 116 ranges from about 0.003 to about 0.004 of an inch. Such a glove has surprising been discovered to provide eight times the water absorption capability of a standard latex glove (4-5 mils thickness) lacking a foam layer.

Figure 4:
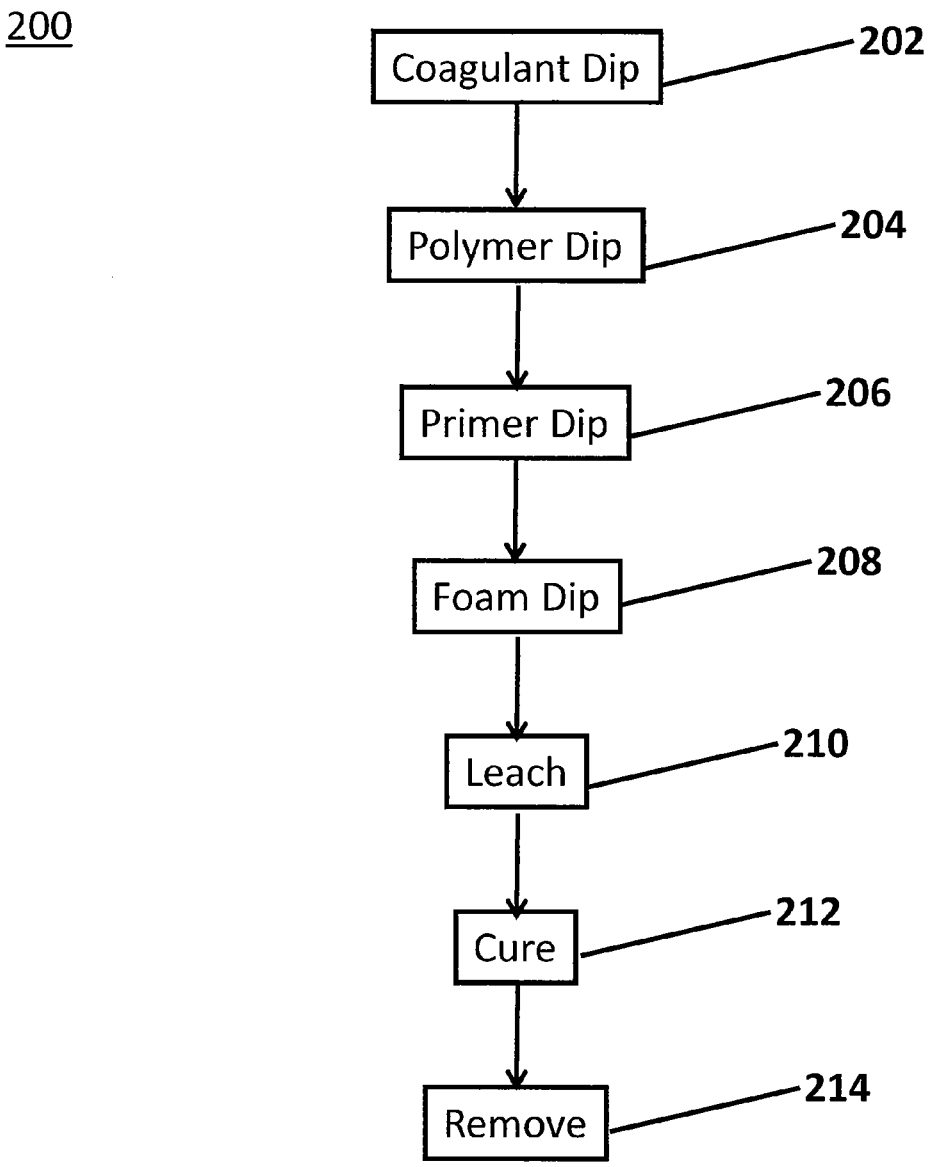
FIG. 4 depicts a flow diagram of a process to make gloves, in accordance with embodiments of the invention.

FIG. 4 depicts a flow diagram of a process to make articles such as gloves, in accordance with embodiments of the invention. Process 200 can start by immersing or dipping a former into a tank having a coagulant at step 202 (optional). In some embodiments, the optional coagulant is applied by a spraying or sputtering process. The coagulant destabilizes the emulsion, helping to form an elastomeric coating. At step 204, the former having the coagulant disposed thereon is dipped into a tank having a polymeric, elastomeric, or latex emulsion or dispersion therein, forming a non-foamed coating on the former (which can be termed a shell, or a structural or liquid resistant layer). The shell can be formed from one step 204, or two or more steps 204, with or without intermediate steps 202.

At step 206, the shell on the former can optionally be dipped in primer, which can in embodiments be effected by dipping into the coagulant tank of step 202. The primer can be any coagulant, such as 2.5% calcium nitrate in water.

After the final step 204 and, if conducted, step 206, the shell coating of non-foamed elastomeric, polymeric, or latex is still a wet gel. In step 208, the former having the wet gel shell disposed thereon is dipped into a tank containing a foamed emulsion or dispersion, thereby forming a foamed coating on the shell. The foamed emulsion is a high viscosity elastomeric, polymeric, or latex emulsion that is foamed for example using high speed whiskers. The air content of the emulsion, in some embodiments of the invention, ranges from about 30 to about 60% or 70% such as about 50 to about 70%. Also, the emulsion remains stable and able to maintain this level of air content because of the high viscosity of the emulsion. In some embodiments, the viscosity ranges from about 400-800 centipoise at between 25-35° C. In at least one exemplary embodiment of the present invention, the viscosity of the emulsion in the tank ranges from about 500-600 centipoise at 30° C. In contrast, for a typical dipping process, the viscosity of an emulsion in a dipping tank is low, typically 6-10 centipoise.

The viscosity can be measured by using Brookfield Viscometer (LVT) with spindle no 2 and speed no 5 (Brookfield Eng. Laboratories, Middleboro, Mass.).

Fillers and thickeners, such as minerals, including thixotropic fillers, such as bentonite (e.g., OPTIGEL CK solution from Rockwood Additives Limited, UK) can be added. Thixotropic fillers are particularly useful for foamed fiber composite compositions. In embodiments, the amount of such thixotropic filler in the formulation is from about 0.2 to about 3 phr, or about 0.3 to about 1 phr.

The former is then removed from the foamed emulsion tank and process 200 can proceed to step 210, leaching. The leaching step can comprise for example submerging the coated former into an aqueous bath. For example, the bath may be water at room temperature, further comprising a turbulent flow within the bath. The leaching step removes surface latex, thereby generally exposing more area of the open cells.

Figure 5A:
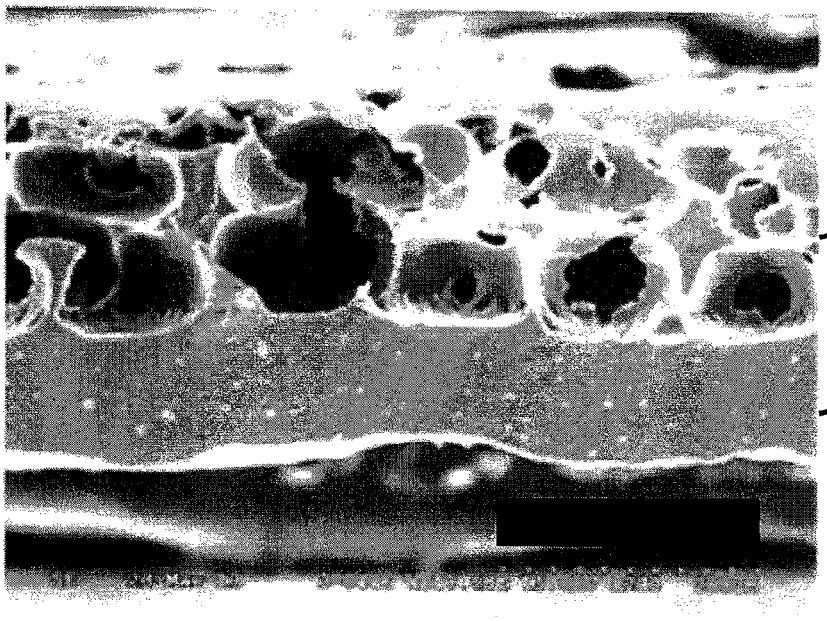
FIG. 5A shows in cross-section a foam application that was cured without prior leaching.
Figure 5B:
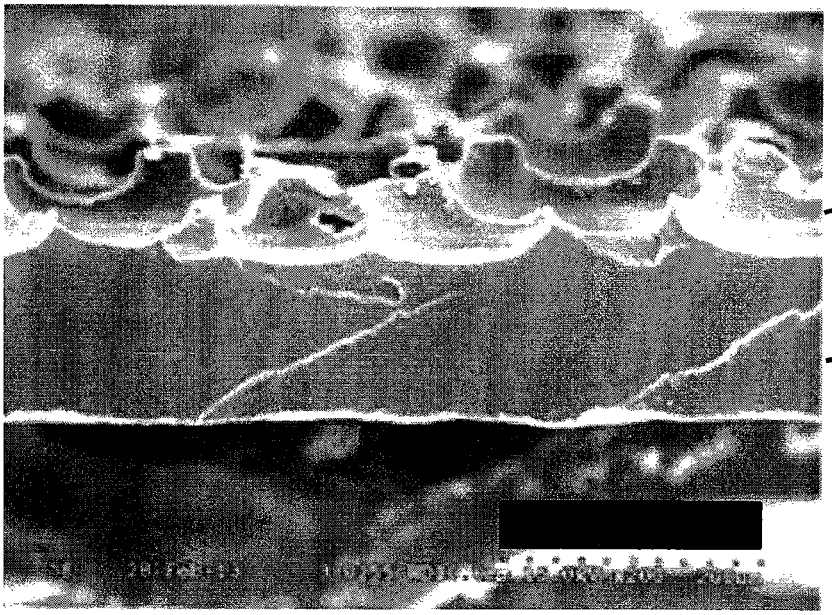
FIG. 5B shows a foam application conducted with leaching.
Figure 5C:
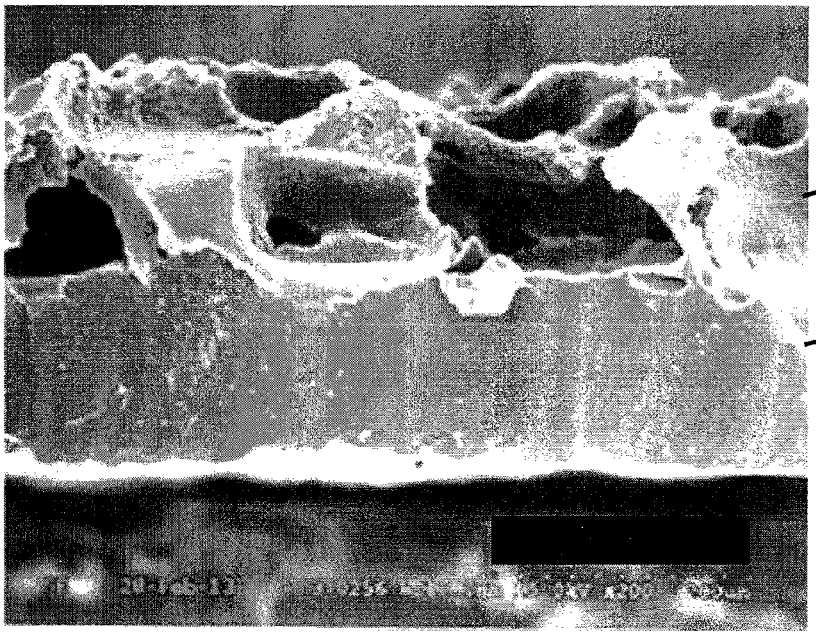
FIG. 5C shows another foam application with leaching.
Figure 6C:
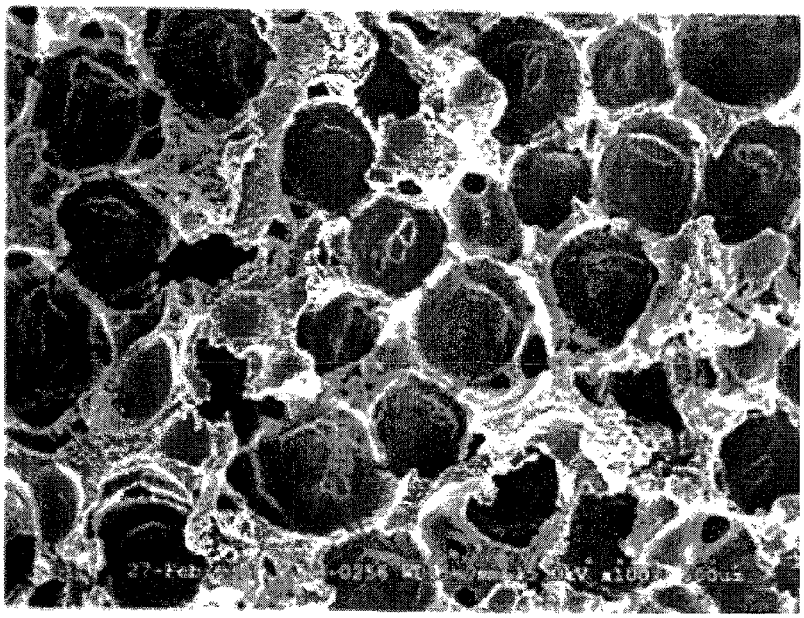
FIGS. 6A-6C show top views for the foam applications of FIGS. 5A-5C.
Figure 6A:
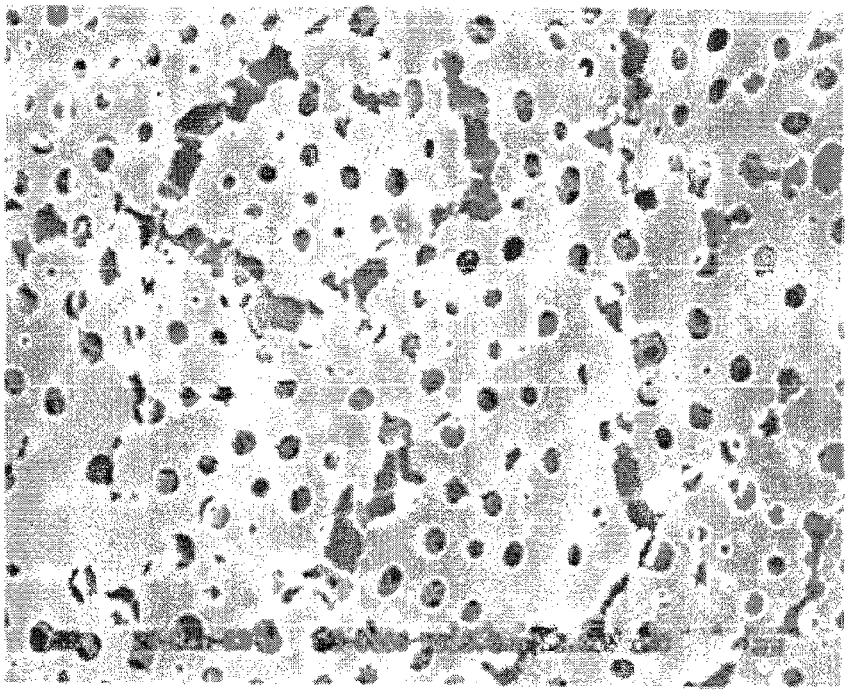
Figure 6B:
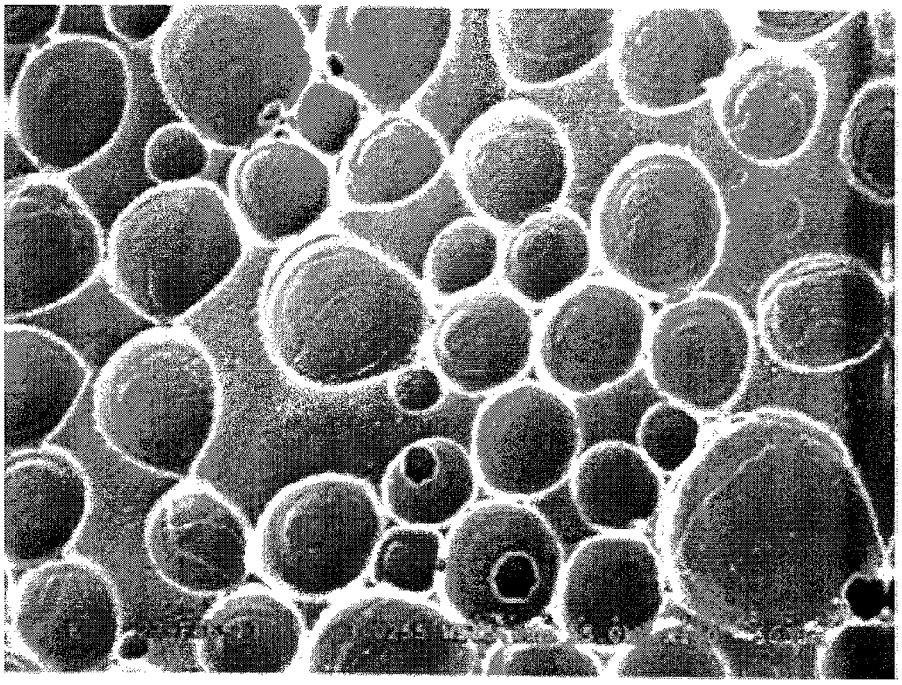

FIG. 5A shows in cross-section a foam application that was cured without prior leaching, forming foam layer 116'. FIG. 5B shows a foam application conducted with leaching. FIG. 5C shows another foam application with leaching. FIGS. 6A-6C show corresponding top views. The bars shown in FIGS. 5A-6C represent 200 mcm. The scale of FIGS. 6A-6C is about 2.5 less magnified than FIGS. 5A-6C.

Without being bound by theory, it is believed that the foam coagulates from the shell side first. In embodiments of the method, the time of leaching, and the time of leaching initiation, and the vigorousness of leaching are selected so that 10%, 15%, 20%, 25%, 30%, 35%, 40%, 55%, or 50% or more of the foam mass is removed, leaving a water-absorbing coating on the shell. Removal can be measured by wet weight prior to curing, or by post-curing weight measured against a no-leach control.

Without being bound by theory, it is believed that creates additional open cells on the surface of the foamed layer, allowing even greater water absorption and adsorption during end use. Moreover, the leaching step controls the thickness of the foamed layer as desired. After leaching, process 200 then proceeds to step 212, at which point the former having foam and structural or liquid resistant layers disposed thereon is cured, such as by oven curing. In some embodiments, the former having foam and structural or liquid resistant layers disposed thereon are placed into an oven heated to approximately 100° C. to 150° C. for approximately 10 to 60 minutes. In some embodiments of the invention, the former having foam and structural or liquid resistant layers disposed thereon are placed into an oven heated to approximately 120° C. to 140° C. for approximately 12 to 40 minutes. The formers may then be removed from the oven, allowed to cool, and the articles removed at step 214. Removal typically inverts the article so that the foamed layer is within the interior of the article. If an exterior application is sought, the gloves are again inverted. The resulting elastomeric layer replicates the shape of the former.

In embodiments, the water absorption of the foam layer, such as a 1-10 mil foam layer, or a 1-5 mil foam layer, or a 1-4 mil foam layer, or a 1-2 mil foam layer, or a 3-4 mil foam layer, is 0.10 g/dm2 or more, such as 0.11 g/dm2 or more, 0.12 g/dm2 or more, 0.13 g/dm2 or more, 0.14 g/dm2 or more, or 0.15 g/dm2 or more.

In embodiments, one or more of the polymer layers (e.g., 114, 116) have density consistent with aqueous latex dipping (as opposed for example to a density consistent with injection molding). In certain embodiments, the structural or liquid resistant layers have other properties (such as elasticity) consistent with aqueous latex dipping. These densities or other properties can vary with the polymer content of the elastomeric layers.

In embodiments, the article is a glove. In embodiments, the article is a bootie. In embodiments, the article is any other polymer article compatible with adhering a dip-applied foam to form an absorbent layer. The absorbent layer can also serve as a textured, grip-enhancing layer.

As discussed above, gloves in accordance with the present invention may comprise one or more polymeric, elastomeric, or latex materials in forming a double-layered coating. Layers can comprise natural or synthetic polymeric coatings or mixtures or blends thereof. For example, a layer coating may comprise a natural latex, such as guayule or polyisoprene, synthetic latexes, such as synthetic polyisoprene, carboxylated acrylonitrile butadiene, non-carboxylated acrylonitrile butadiene, nitrile generally, butyl latex, polychloroprene, aqueous- and non-aqueous-polyurethanes, styrene-butadiene, and the like, or mixtures or blends thereof. As discussed above, for at least one exemplary embodiment of the present invention, an foam layer and/or an structural layer comprise natural rubber latex. Alternatively, in at least one exemplary embodiment of the present invention, foam layer and/or structural layer comprise a carboylated-nitrile butadiene rubber material (meaning that the polymer component is 80% or more, or 90% or more, or 100% or more by weight carboxylated-nitrile butadiene).

The temperature of the elastomeric emulsion may be controlled, as is known in the art, and may include additives, such as surfactants, to control or modify the physical properties of the elastomeric emulsion and/or resulting article formed thereby. The emulsion may also comprise various accelerants, stabilizers, pigments, and the like. In some embodiments, the emulsion comprises additives, such as bentonite and other clays, minerals, silica, and like thickeners, to control the rheological properties of the emulsion. The emulsion of one or more embodiments may also include a cure package or vulcanization agents to promote crosslinking during the curing process, such as sulfur and/or other suitable crosslinking agents known to those in the art. Formers may comprise a glass, ceramic, metallic, or other material known in the art.

As discussed above, embodiments of the invention comprise the step of disposing a coagulant on the former before dipping the former into a bath or tank containing an elastomeric emulsion as otherwise described herein. In one or more embodiments, the former may be dipped in a bath or tank containing an elastomeric emulsion without the use of a coagulant component. Suitable coagulants include, but are not limited to, calcium chloride, calcium nitrate, calcium citrate, tricarboxylic acid, acetic acids, formic acids, and salts known to those in the art.

In embodiments, one or more of the polymer that are a structural or moisture resistant layer have density consistent with aqueous latex dipping (as opposed for example to a density consistent with injection molding). In embodiments, the moisture-resistant layers have other properties (such as elasticity) consistent with aqueous latex dipping. These densities or other properties can vary with the polymer content of the elastomeric layers.

In embodiments, the gloves are packaged with the liquid absorbent layer disposed on the interior of the gloves. For example, pairs of the gloves can be sterilely so packaged in a pull-apart envelope. Or multiple gloves can be boxed with the gloves so configured. In embodiments, articles of the invention are wearable with the absorbent side interior, and are packaged such that they can be donned without inverting them.

The invention can be further described with reference to the following numbered embodiments:

Embodiment 1

A cured absorbent composite glove such as a glove comprising: a structural or liquid resistant layer, the structural or liquid resistant comprising a non-foamed polymer material; and a liquid absorbent layer affixed to the liquid resistant layer, which is (a) formed of a foamed polymeric (e.g., elastomeric) material, wherein the absorbent layer includes open cells for sweat management, or (b) has a thickness of 1 to 5 mil and a water absorption of 0.10 g/dm2 or higher.

Embodiment 2

The a wearable article of embodiment 1 packaged with the liquid absorbent layer on the inside.

Embodiment 3

The article of one of the foregoing embodiments, or a combination thereof, wherein the structural or liquid resistant layer and absorbent layer comprise the same polymer material.

Embodiment 4

The article of embodiment 3, wherein the structural or liquid resistant layer and absorbent layer comprise nitrile.

Embodiment 5

The article of one of the foregoing embodiments, wherein the polymer material of the layers comprises natural latex, guayule, polyisoprene, synthetic latexes, nitrile, nitrile-butadiene rubber, butadiene, non-carboxylated acrylonitrile butadiene, carboxylated acrylonitrile butadiene, butyl latex, polychloroprene, polyurethane, styrene-butadiene, acrylonitrile-butadiene, or blends thereof.

Embodiment 6

The article of one of the foregoing embodiments, or a combination thereof, wherein the thickness of the structural or liquid resistant ranges from about 0.004 to 0.005 inches (or another thickness range recited herein) and the thickness of the absorbent layer ranges from about 0.001 to about 0.004 inches (or another thickness range recited herein), and the absorbent layer has a water absorption of 0.10 g/dm2 or higher (or another absorption range recited herein).

Embodiment 7

The article of one of the foregoing embodiments, or a combination thereof, wherein the thickness of the absorbent layer ranges from about 0.001 to about 0.002 inches.

Embodiment 8

A method of forming an article, comprising: disposing a coagulant on a former; applying a non-foamed elastomeric material on the former, forming a non-foamed layer; applying a foamed elastomeric material on the non-foamed layer, forming a foamed coating on the non-foamed layer; leaching the foamed layer to remove 10% or more but not all of the initial foamed layer; and curing the non-foamed layer and the remaining foamed layer, to form the article, the foamed layer of the article having water absorption of 0.10 g/dm2 or higher.

Embodiment 9

The method of embodiment 8, wherein the article is wearable with the water absorbent layer interior, and further comprising the step of packaging the article with the liquid absorbent layer configured so that the article can be donned without fully inverting it. Typically, the glove needs no inversion, or is half inverted with the non-thumb digits non-inverted so that the glove can be more conveniently donned with the liquid absorbent layer interior (i.e., the glove is configured for donning with the liquid absorbent layer interior).

Embodiment 10

The method of one of embodiments 8-9, further comprising the step of applying a coagulant to the non-foamed layer following the applying a non-foamed elastomeric material step.

Embodiment 11

The method of one of embodiments 8-10, or a combination thereof, wherein the foamed elastomeric material has a viscosity from about 400 to about 800 centipoise at 25-35° C. (or another viscosity range recited herein).

Embodiment 12

The method of embodiment 11, wherein the foamed elastomeric material has a viscosity from about 500 to about 600 centipoise at 30° C.

Embodiment 13

The method of one of embodiments 8-12, or a combination thereof, wherein the foamed elastomeric material has an air content from about 50% to about 70% (or another air content range described herein).

Embodiment 14

The method of one of embodiments 8-13, or a combination thereof, wherein the foamed elastomeric material comprises about 0.2 to about 3 phr of thixotropic filler (or another range for thixotropic filler recited herein).

Embodiment 15

The method of one of embodiments 8-14, or a combination thereof, wherein the foamed elastomeric material comprises about 0.3 to about 1 phr of thixotropic filler.

Embodiment 16

The method of one of embodiments 8-15, or a combination thereof, wherein curing comprises heating to approximately 100° C. to 150° C. for approximately 10 to 60 minutes.

Embodiment 17

The method of one of embodiments 8-16, or a combination thereof, wherein curing comprises heating to approximately 120° C. to 140° C. for approximately 12 to 40 minutes (or another curing or curing time recited herein).

Embodiment 18

The method of one of embodiments 8-17, or a combination thereof, wherein leaching comprises removing 20% or more but not all of the initial foamed layer (or another amount of removal described herein).

All ranges recited herein include ranges therebetween, and can be inclusive or exclusive of the endpoints. Optional included ranges can be from integer values therebetween, at the order of magnitude recited or the next smaller order of magnitude. For example, if the lower range value is 0.2, optional included endpoints can be 0.3, 0.4 . . . 1.1, 1.2, and the like, as well as 1, 2, 3 and the like; for example, if the higher range is 8, optional included endpoints can be 7, 6, and the like.

Reference throughout this specification to "one embodiment," "certain embodiments," "one or more embodiments" or "an embodiment" means that a particular feature, structure, material, or characteristic described in connection with the embodiment is included in at least one embodiment of the invention. Thus, the appearances of the phrases such as "in one or more embodiments," "in certain embodiments," "in one embodiment" or "in an embodiment" in various places throughout this specification are not necessarily referring to the same embodiment of the invention. Furthermore, the particular features, structures, materials, or characteristics may be combined in any suitable manner in one or more embodiments.

While the foregoing is directed to embodiments of the present invention, other and further embodiments of the invention may be devised without departing from the basic scope thereof, and the scope thereof is determined by the claims that follow.

The invention claimed is:

1. A cured absorbent composite glove comprising:

a structural layer comprising a non-foamed polymer material; and a liquid absorbent layer affixed to the liquid resistant layer, which is formed of a foamed polymeric material, includes open cells for sweat management, has a thickness of about 1 to about 5 mil, and has a water absorption due to the open cells of 0.10 g/dm$^2$ or higher.

2. The cured absorbent composite glove of claim 1, packaged with the liquid absorbent layer configured to provide the inside surface.

3. The glove of claim 1, wherein the structural layer and absorbent layer comprise a same polymer material.

4. The glove of claim 3, wherein the structural layer and absorbent layer comprise nitrile.

5. The glove of claim 1, wherein the polymer material of the structural and absorbent layers comprise natural latex, guayule, polyisoprene, synthetic latexes, nitrile, nitrile-butadiene rubber, butadiene, non-carboxylated acrylonitrile butadiene, carboxylated acrylonitrile butadiene, butyl latex, polychloroprene, polyurethane, styrene-butadiene, acrylonitrile-butadiene, or blends thereof.

6. The glove of claim 2, wherein the thickness of the structural layer ranges from about 0.004 to 0.005 inches, the thickness of the absorbent layer ranges from about 0.001 to about 0.004 inches, and the absorbent layer has a water absorption of 0.12 g/dm$^2$ or higher.

7. The glove of claim 6, wherein the thickness of the absorbent layer ranges from about 0.001 to about 0.002 inches.

8. A method of forming an article, comprising:

disposing a coagulant on a former;

applying a non-foamed elastomeric material on the former, forming a non-foamed layer;

applying a foamed elastomeric material on the non-foamed layer, forming a foamed coating on the non-foamed layer;

leaching the foamed layer to remove 10% or more but not all of the initial foamed layer; and curing the non-foamed layer and the remaining foamed layer, to form the article, the foamed layer of the article having a thickness of about 1 to about 5 mil and water absorption of 0.10 g/dm$^2$ or higher.

9. The method of claim 8, wherein the article is wearable with the water absorbent layer interior, and further comprising the step of packaging the article with the liquid absorbent layer configured so that the article can be donned without inverting it.

10. The method of claim 8, further comprising the step of applying a coagulant to the non-foamed layer following the applying a non-foamed elastomeric material step.

11. The method of claim 8, wherein the foamed elastomeric material has a viscosity from about 400 to about 800 centipoise at 25-35° C.

12. The method of claim 11, wherein the foamed elastomeric material has a viscosity from about 500 to about 600 centipoise at 30° C.

13. The method of claim 8, wherein the foamed elastomeric material has an air content from about 50% to about 70%.

14. The method of claim 8, wherein the foamed elastomeric material comprises about 0.2 to about 3 phr of thixotropic filler.

15. The method of claim 8, wherein the foamed elastomeric material comprises about 0.3 to about 1 phr of thixotropic filler.

16. The method of claim 8, wherein curing comprises heating to approximately 100° C. to 150° C. for approximately 10 to 60 minutes.

17. The method of claim 8, wherein curing comprises heating to approximately 120° C. to 140° C. for approximately 12 to 40 minutes.

18. The method of claim 8, wherein leaching comprises removing 20% or more but not all of the initial foamed layer.

19. The method of claim 8, wherein leaching comprises removing 30% or more but not all of the initial foamed layer.

20. The method of claim 8, wherein the foamed layer has water absorption of 0.14 g/dm$^2$ or higher.

21. The glove of claim 2, wherein the thickness of the structural layer ranges from about 0.004 to 0.005 inches, the thickness of the absorbent layer ranges from about 0.001 to about 0.004 inches, and the absorbent layer has a water absorption of 0.14 g/dm$^2$ or higher.

22. The glove of claim 21, wherein the thickness of the absorbent layer ranges from about 0.001 to about 0.002 inches.

* * * * *